US010924830B2

(12) United States Patent
Gu

(10) Patent No.: US 10,924,830 B2
(45) Date of Patent: Feb. 16, 2021

(54) RECEIVER MODULE

(71) Applicant: AAC Technologies Pte. Ltd., Singapore (SG)

(72) Inventor: Xiaojiang Gu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/529,761

(22) Filed: Aug. 1, 2019

(65) Prior Publication Data

US 2020/0053446 A1 Feb. 13, 2020

(30) Foreign Application Priority Data

Aug. 10, 2018 (CN) ..... 201810911893.3

(51) Int. Cl.
*H04R 1/02* (2006.01)
*H04R 1/04* (2006.01)
*H04R 1/22* (2006.01)

(52) U.S. Cl.
CPC ..... *H04R 1/026* (2013.01); *H04R 1/04* (2013.01); *H04R 1/222* (2013.01)

(58) Field of Classification Search
CPC ..... H04R 1/025; H04R 1/026; H04R 1/04; H04R 2400/11; H04R 2499/11
USPC ..... 381/386, 389, 301
See application file for complete search history.

(56) References Cited

U.S. PATENT DOCUMENTS

2012/0155693 A1* 6/2012 Wei ..... H04R 9/10 381/386
2014/0064544 A1* 3/2014 Zukowski ..... H04R 1/086 381/360

* cited by examiner

*Primary Examiner* — Melur Ramakrishnaiah
(74) *Attorney, Agent, or Firm* — W&G Law Group LLP

(57) ABSTRACT

The present disclosure provides a receiver module including a receiver and a microphone. The receiver includes a holder, a vibration unit, a magnetic circuit unit, a front cover, a cover plate, and a mounting block. The vibration unit includes a diaphragm spaced apart from the cover plate to form a front cavity. The front cover includes a front cover body portion, a front cover extension portion, and a first through-hole. The mounting block is fixed on a side of the front cover extension portion facing away from the cover plate and has a second through-hole communicating with the first through-hole. The microphone is fixed on the mounting block, and the front cavity, the first through-hole, the second through-hole and a sound inlet hole of the microphone communicates with each other. The microphone shares the front cavity with the receiver to absorb noise, thereby providing better sound effect.

9 Claims, 4 Drawing Sheets

RECEIVER MODULE

TECHNICAL FIELD

The present disclosure relates to the technical field of acoustic-electric conversion, and particularly, to a receiver module applied to a portable communication device.

BACKGROUND

With the rapid development of science and technology, people are pursuing a higher life quality, while raising higher requirements on portable multimedia audio-visual devices, such as notebook computers, mobile phones and those used as important terminal devices in daily life, particularly on the performance of their sound effects. Therefore, there is a higher and higher requirement on a receiver used as an important component for converting electrical signals into sound.

The receiver in the related art includes a holder having an receiving space, a vibration unit and a magnetic circuit unit fixedly held by the holder, a front cover covering the holder, and a cover plate stacked at a side of the front cover facing away from the holder. The vibration unit includes a diaphragm interposed between the holder and the front cover, and the cover plate is spaced apart from the diaphragm to form a front cavity. However, the receiver in the related art causes noise during communicating, which negatively affects the sound effect.

Therefore, it is urgent to provide an improved receiver module, in order to solve the above problem.

BRIEF DESCRIPTION OF DRAWINGS

Many aspects of the exemplary embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

Figure 1:
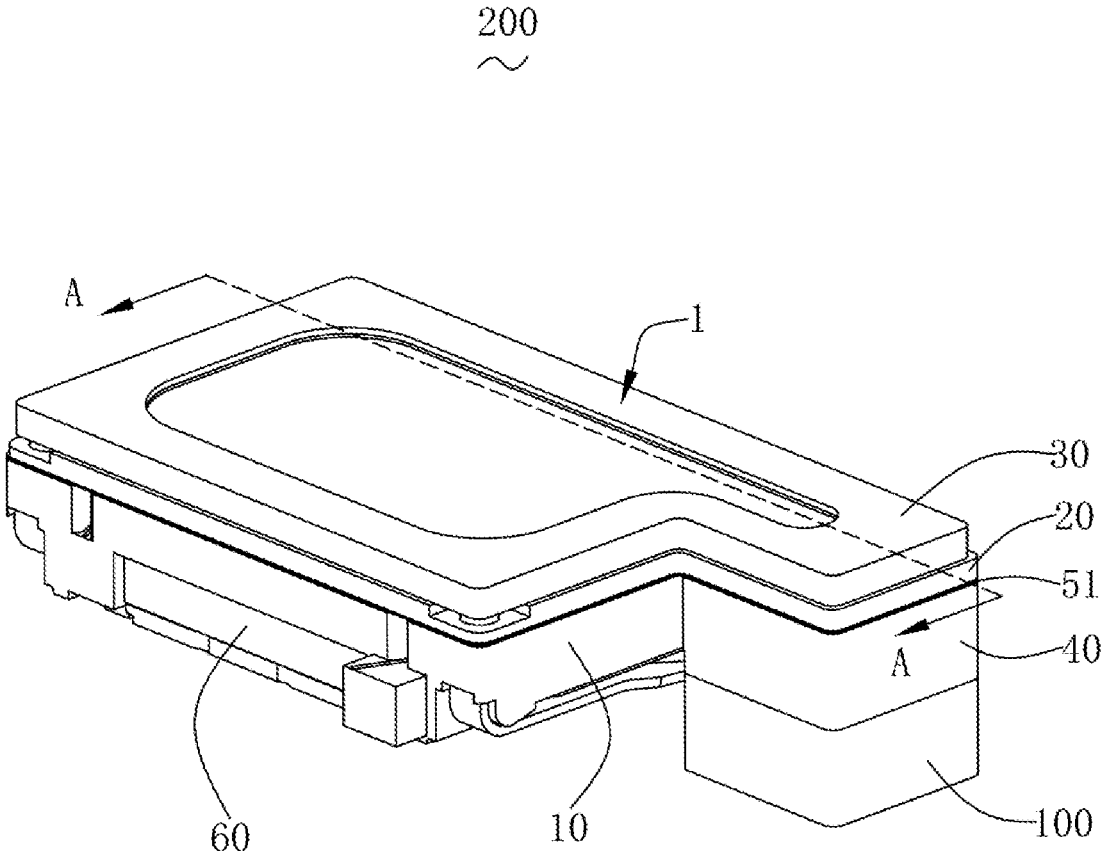
FIG. 1 is a schematic diagram showing a three-dimensional assembly structure of a receiver module provided by the present disclosure.
Figure 2:
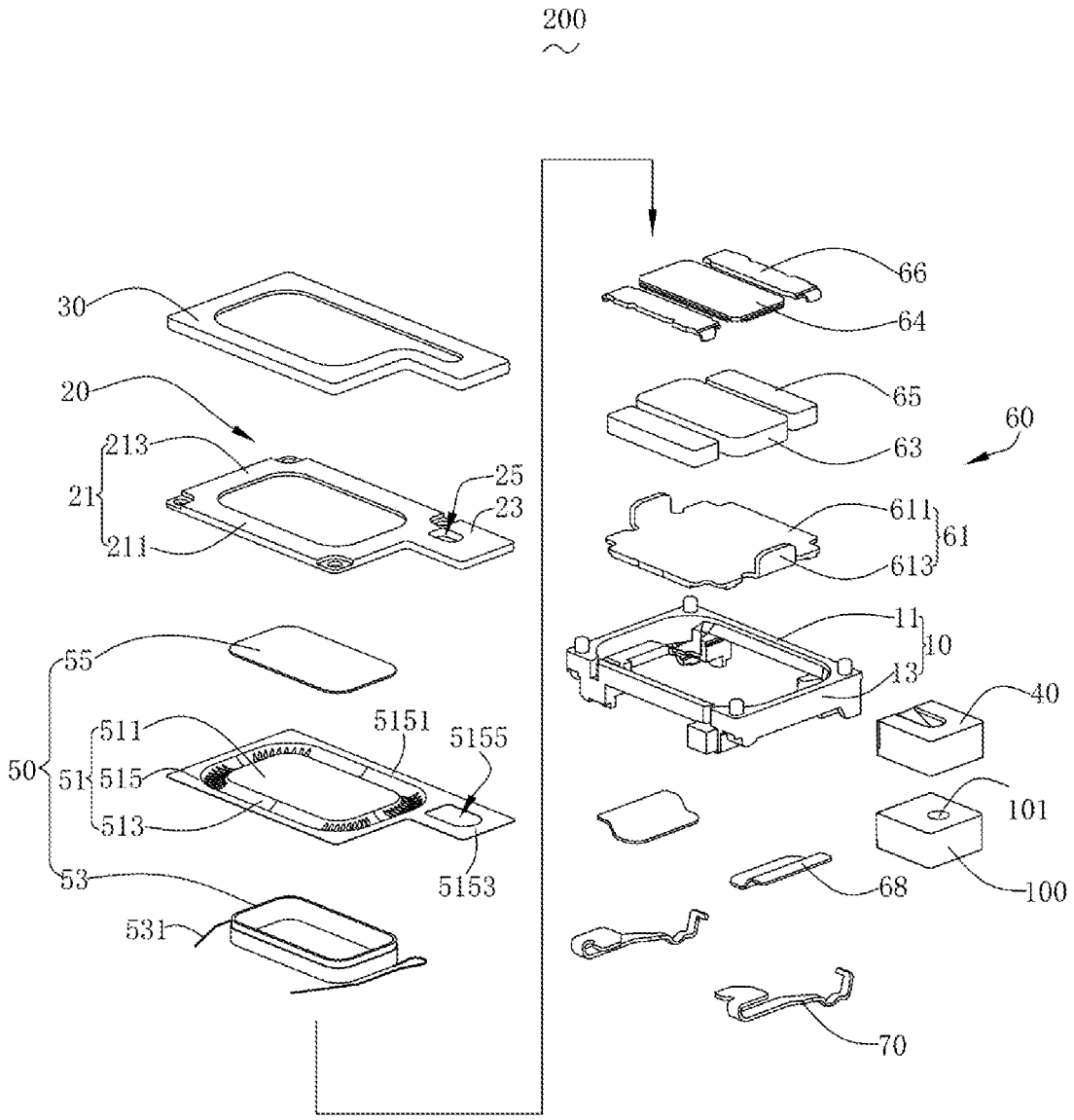
FIG. 2 is a schematic diagram showing a three-dimensional exploded structure of the receiver module of FIG. 1.
Figure 3:
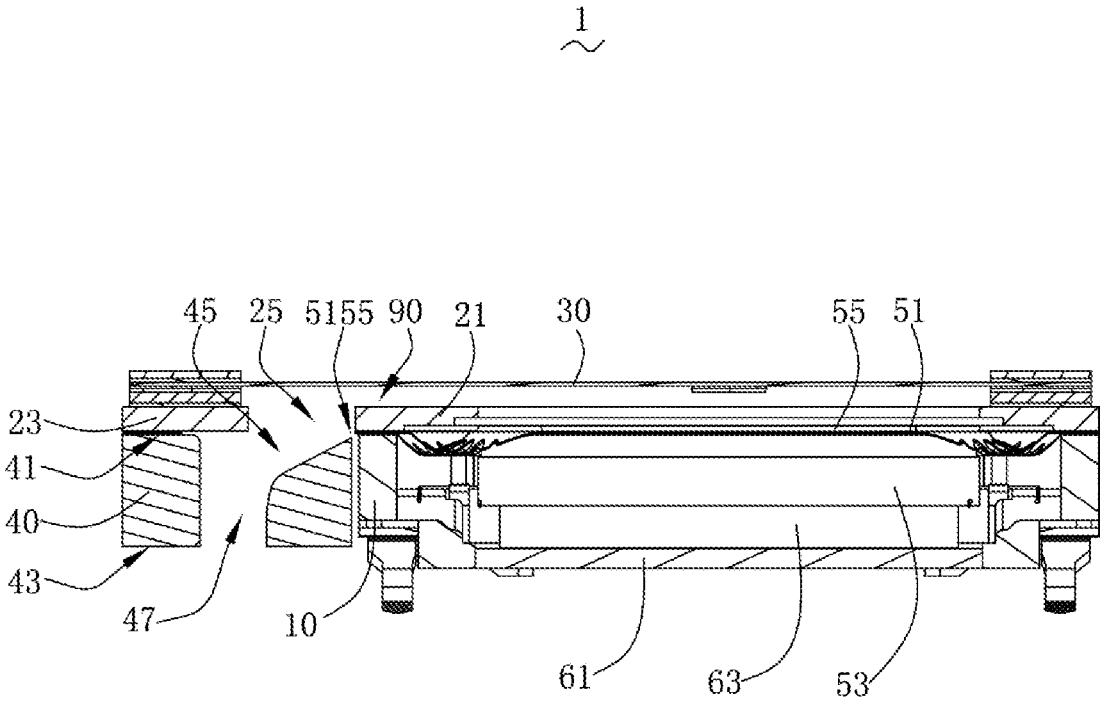
FIG. 3 is a cross-sectional view of the receiver of FIG. 1 taken along line A-A.
Figure 4:
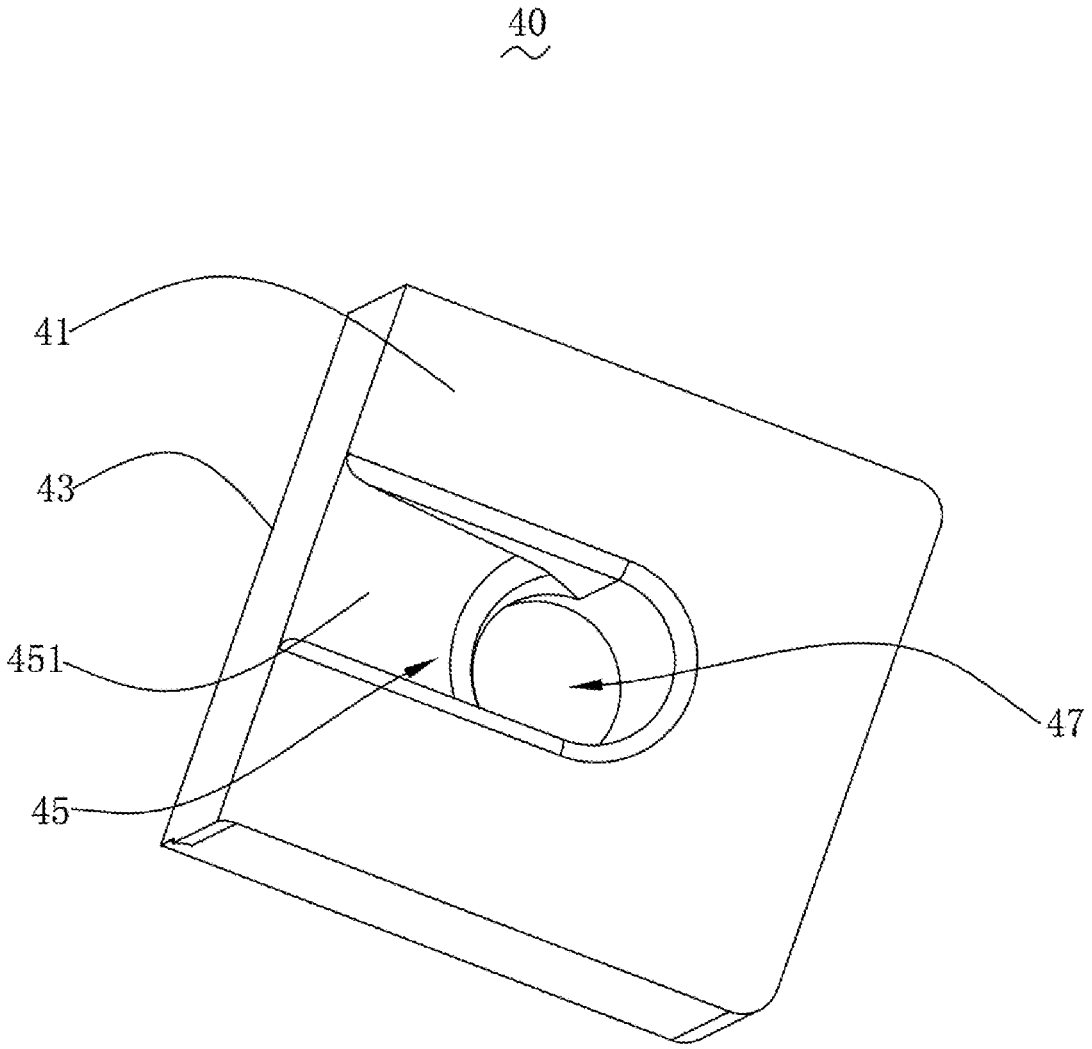
FIG. 4 is a schematic diagram showing a three-dimensional structure of a mounting block in the receiver of FIG. 1.

The present disclosure will be further illustrated with reference to the accompanying drawings and the embodiments.

As shown in FIG. 1 to FIG. 4, an embodiment of the present disclosure provides a receiver module 200. The receiver module 200 includes a receiver 1 and a microphone 100 fixedly connected to the receiver 1. The microphone 100 has a sound inlet hole 101 communicating with a front cavity of the receiver 1. That is, the microphone and the receiver share the front cavity, so that the microphone can absorb communication noise in the receiver and improve the sound effect of the receiver module.

The receiver 1 includes a holder 10 having an receiving space, a front cover 20 covering the holder 10, a cover plate 30 stacked on a side of the front cover 20 facing away from the holder 10, a mounting block 40 fixedly connected to the front cover 20, a vibration unit 50 and a magnetic circuit unit 60 fixedly held by the holder 10, and a conductive terminal 70 for electrically connecting the vibration unit 50 and an external circuit. The vibration unit 50 includes a diaphragm 51 interposed between the front cover 20 and the holder 10, and the cover plate 30 is spaced apart from the diaphragm 51 to form a front cavity 90.

The holder 10 includes a pair of long side walls 11 that are disposed opposite to each other, and a pair of short side walls 13 that are disposed opposite to each other. The two long side walls 11 and the two short side walls 13 are connected end to end to form a rectangular ring structure.

The front cover 20 includes a front cover body portion 21 covering the holder 10, a front cover extension portion 23 that extends from the front cover body portion 21 along a direction facing away from the front cover body portion 21, and a first through-hole 25 provided in the front cover extension portion 23 and communicating with the front cavity 90.

The front cover body portion 21 includes a pair of long side edges 211 that are disposed opposite to each other, and a pair of short side edges 213 that are disposed opposite to each other. The two long side edges 211 and the two short side edges 213 are connected end to end to form a rectangular ring structure. The long side edges 211 are correspondingly connected to the long side walls 11, and the short side edges 213 are correspondingly connected to the short side walls 13. The front cover extension portion 23 is formed by extending horizontally from one of the short side edges in a direction facing away from the other one of the short side edges.

The mounting block 40 is disposed on a side of the front cover extension portion 23 facing away from the cover plate 30 and fixedly connected to the front cover extension portion 23. In an embodiment, the mounting block 40 is fixedly connected to the front cover extension portion 23 through the diaphragm 51. That is, the diaphragm 51 is interposed between the mounting block 40 and the front cover extension portion 23 and fixedly connected to these two.

The mounting block 40 includes an upper surface 41 connected to the front cover extension portion 23, a lower surface 43 disposed opposite to the upper surface 41, a groove 45 recessed from the upper surface 41 toward the lower surface 43 and having a groove bottom 451, and a second through-hole 47 formed by penetrating through the groove bottom 451. The microphone 100 is mounted on the lower surface 43. That is, the cover plate 30, the front cover 20, the diaphragm 51 and the microphone are stacked in a sequence from top to bottom. The front cavity 90, the first through-hole 25, the groove 45, the second through-hole 47, and the sound inlet hole 101 of the microphone 100 communicate with one another. In this way, the air in the front cavity 90 is led out to a back side of the receiver 1 facing away from the front cavity 90 via the first through-hole 25, the groove 45 and the second through-hole 47, and absorbed by the microphone 100. Therefore, the noise is eliminated and the sound effect of the receiver 1 is improved. It should be noted that, in the present embodiment as shown in FIG. 1, the back side of the receiver is the lower side thereof.

In an embodiment, the groove 45 has a caliber gradually decreasing in a direction from the first through-hole 25 to the second through-hole 47. In this embodiment, the groove 45 is formed by an U-shaped first side wall and a bottom wall connected to the first side wall. The bottom wall is a sloped surface, such that a distance between the upper surface and one end of the bottom wall close to the holder is smaller than a distance between the upper surface and the other end of the bottom wall close to the second through-hole.

In an embodiment, the mounting block 40 is a rectangular plastic block. That is, the mounting block 40 is a cuboid or a cube. In other cases, the mounting block 40 may have other shapes, which is not limited herein.

In an embodiment, the first through-hole 25 is has a larger size than the second through-hole 47, and the size of the first through-hole 25 is smaller than an opening size of the groove 45.

In an embodiment, an orthographic projection of the first through-hole 25 on the groove bottom 451 of the groove 45 completely falls within the groove bottom 451 of the groove 15, and an orthographic projection of the second through-hole 47 on the front cover extension portion 23 partially locates outside the first through-hole 25.

In the present embodiment, the second through-hole 47 is a circular through-hole.

In the present embodiment, the mounting block 40 is spaced apart from the short side wall 13 of the holder 10. In other embodiments, the mounting block 40 can also abut against the short side wall 13. In a vibration direction of the vibration unit 20, the mounting block 40 has a greater height than the short side wall 13.

In the present disclosure, by additionally providing the mounting block 40 having the second through-hole 47 and fixing the microphone onto the lower surface 43 of the mounting block 40, the air in the front cavity 90 of the receiver 1 is led to the sound inlet hole of the microphone and absorbed by the microphone, thereby eliminating the communication noise and improving the sound effect.

The vibration unit 50 further includes a voice coil 53 located below the diaphragm 51 and configured to drive the diaphragm 51 to vibrate and sound, and a dome 55 configured to intensify the vibration of the diaphragm 51.

The diaphragm 51 includes a vibrating portion 511 at a central position, a suspension portion 513 surrounding the vibrating portion 511, and a fixing portion 515 extending from a peripheral edge of the suspension portion 513. The fixing portion 515 includes a first fixing portion 5151 interposed between the holder 10 and the front cover body portion 21, a second fixing portion 5153 extending from the first fixing portion 5151 and interposed between the front cover extension portion 23 and the upper surface 41 of the mounting block 40, and a third through-hole 5155 provided at a position corresponding to the groove 45. Two ends of the third through-hole 5155 communicate with the first through-hole 25 and the groove 45, respectively. In the present embodiment, the third through-hole 5155 has the same shape as the opening of the groove 45.

The dome 55 is attached on a surface of the vibrating portion 511 close to the cover plate 30.

The magnetic circuit unit 60 includes a yoke 61 buckled and held at the bottom of the holder 10, a main magnet 63 fixed at a central position of the yoke 61, a main pole plate 64 attached on a surface of the main magnet 63 facing the diaphragm 51, auxiliary magnets 65 disposed on two sides of the yoke 61, an auxiliary pole plate 66 attached on a surface of the auxiliary magnet 65 facing the diaphragm 51, and damping sheets 68.

The yoke 61 includes a bottom plate 611, and side plates 613 extending from two ends of the bottom plate 611 in a direction facing towards the diaphragm 51. The main magnet 63 is spaced apart from each of the side plates 613 and the auxiliary magnets 65 so as to form a magnetic gaps, in which the voice coil 53 is inserted.

The bottom plate 611 further includes mounting portions recessed from a surface of the bottom plate 611 facing away from the front cover 20 in a direction facing towards the diaphragm 51, and the mounting portions are symmetrically disposed at two ends of the bottom plate 611. One end of the damping sheet 68 is connected to the mounting portion, and the other end of the damping sheet 68 is fixedly connected to a surface of the short side wall 13 of the holder 10 facing away from the diaphragm 51. The damping sheet 68 can shield a leaking portion between the holder 10 and the yoke 61 and provides a dustproof function. Further, since the air in an inner cavity may be compressed when the diaphragm 51 is vibrating, and the damping sheet functions to buffer the compressed air to a certain extent, thereby improving acoustic resistance of the product and thus improving the acoustic performance of the product.

The conductive terminal 70 is configured to be electrically connected to an external circuit. In the present embodiment, two conductive terminals 70 are provided, and the two conductive terminals 70 are symmetrically mounted below the short side walls 13 of the holder 10 and fixedly connected to the short side walls 13. The voice coil 53 is electrically connected to the conductive terminals 70 through a voice coil lead wire 531 of the voice coil 53.

The receiver module provided by the present disclosure includes the receiver and the microphone fixedly connected to the receiver; the front cover of the receiver includes the front cover body portion covering the holder, the front cover extension portion that extends from the front cover body portion along a direction facing away from the front cover body portion, and the first through-hole provided in the front cover extension portion and communicating with the front cavity; the mounting block mounted below the front cover extension portion and fixedly connected thereto has the second through-hole communicating with the first through-hole; the microphone is mounted on the lower surface of the mounting block and has the sound inlet hole communicating with the second through-hole; the front cavity, the first through-hole, the second through-hole communicates with the sound inlet hole of the microphone, i.e., the receiver and the microphone share the front cavity, and the air in the front cavity can be led out to the back side of the receiver facing away from the front cavity through the first through-hole and the second through-hole, and is absorbed by the microphone to eliminate noise, thereby improving the sound effect of the receiver module.

It should be noted that, the above are merely embodiments of the present invention. Any improvement made by those skilled in the art without departing from the inventive concept of the present invention shall fall within the protection scope of the present invention.

What is claimed is:

1. A receiver module, comprising:

a receiver; and a microphone, wherein the receiver comprises:

a holder;

a vibration unit fixedly held on the holder;

a magnetic circuit unit fixedly held on the holder;

a front cover covering the holder; and a cover plate stacked on a side of the front cover facing away from the holder, wherein the vibration unit comprises a diaphragm interposed between the holder and the front cover, and the cover plate is spaced apart from the diaphragm to form a front cavity, the front cover comprises a front cover body portion covering the holder, a front cover extension portion extending from the front cover body portion along a direction facing away from the front cover body portion, and a first through-hole provided in the front cover extension portion and communicating with the front cavity, the receiver further comprises a mounting block disposed on a side of the front cover extension portion facing away from the cover plate and fixed to the front cover extension portion, and a second through-hole provided in the mounting block and communicating with the first through-hole, the microphone is mounted on a side of the mounting block facing away from the front cover, the front cavity, the first through-hole, the second through-hole and a sound inlet hole of the microphone communicate with one another, and air in the front cavity is led out to a back side of the receiver facing away from the front cavity via the first through-hole and the second through-hole and is absorbed by the microphone to eliminate noise;

the front cover body portion comprises two long side edges arranged opposite to each other and two short side edges arranged opposite to each other, the two long side edges and the two short side edges are connected end to end to form a rectangular ring structure, and the front cover extension portion horizontally extends from one of the two short side edges along a direction facing away from the other one of the two short side edges.

2. The receiver module as described in claim 1, wherein the mounting block is a plastic block.

3. The receiver module as described in claim 1, wherein the mounting block comprises an upper surface connected to the front cover extension portion and a lower surface disposed opposite to the upper surface, and the microphone is mounted on the lower surface.

4. The receiver module as described in claim 3, wherein the mounting block further comprises a groove formed by recessing from the upper surface towards the lower surface and having a groove bottom, the second through-hole penetrates through the groove bottom, and two ends of the groove communicate with the first through-hole and the second through-hole, respectively.

5. The receiver module as described in claim 4, wherein the groove has a caliber decreasing in a direction from the first through-hole to the second through-hole.

6. The receiver module as described in claim 4, wherein the first through-hole has a larger size than the second through-hole, and the size of the first through-hole is smaller than an opening size of the groove.

7. The receiver module as described in claim 6, wherein an orthographic projection of the first through-hole on the groove bottom of the groove falls within the groove bottom of the groove, and an orthographic projection of the second through-hole on the front cover extension portion at least partially locates outside the first through-hole.

8. The receiver module as described in claim 7, wherein the second through-hole is a circular through-hole.

9. The receiver module as described in claim 4, wherein the diaphragm comprises a vibrating portion at a central position, a suspension portion surrounding the vibrating portion, and a fixing portion extending from a peripheral edge of the suspension portion, wherein the fixing portion comprises a first fixing portion interposed between the holder and the front cover body portion, a second fixing portion extending from the first fixing portion and interposed between the front cover extension portion and the mounting block, and a third through-hole provided at a position corresponding to the groove, and the third through-hole has a same shape as an opening of the groove and communicates the first through-hole with the groove.

* * * * *